US010184382B2

(12) United States Patent
Hagiwara et al.

(10) Patent No.: US 10,184,382 B2
(45) Date of Patent: Jan. 22, 2019

(54) ABNORMALITY DIAGNOSIS APPARATUS FOR $NO_x$ STORAGE REDUCTION CATALYST

(71) Applicant: TOYOTA JIDOSHA KABUSHIKI KAISHA, Toyota-shi, Aichi-ken (JP)

(72) Inventors: Koji Hagiwara, Susono (JP); Toru Kidokoro, Hadano (JP); Yasushi Iwazaki, Ebina (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 191 days.

(21) Appl. No.: 15/218,329

(22) Filed: Jul. 25, 2016

(65) Prior Publication Data

US 2017/0030244 A1 Feb. 2, 2017

(30) Foreign Application Priority Data

Jul. 27, 2015 (JP) ..... 2015-147750

(51) Int. Cl.
*F01N 11/00* (2006.01)
*F01N 13/00* (2010.01)
(Continued)

(52) U.S. Cl.
CPC ..... *F01N 11/007* (2013.01); *F01N 3/0814* (2013.01); *F01N 3/0842* (2013.01);
(Continued)

(58) Field of Classification Search
CPC .... F01N 11/007; F01N 13/008; F01N 3/0814; F01N 3/0842; F01N 2550/03; F01N 2560/026; F01N 2560/07; F02D 41/0275
See application file for complete search history.

(56) References Cited

U.S. PATENT DOCUMENTS

2012/0090297 A1* 4/2012 Yacoub ..... F01N 3/0842 60/274

FOREIGN PATENT DOCUMENTS

JP 2009-138605 A 6/2009

* cited by examiner

*Primary Examiner* — Brandon Lee
(74) *Attorney, Agent, or Firm* — Hunton Andrews Kurth LLP

(57) ABSTRACT

An apparatus according to the present invention is adapted to calculate an $NO_X$ storage rate defined as the rate of the quantity of $NO_X$ stored into the NSR catalyst to the quantity of $NO_X$ flowing into the NSR catalyst, based on quantity of $NO_X$ flowing into the NSR catalyst and the quantity of $NO_X$ flowing out of the NSR catalyst in a state in which the amount of $NO_X$ stored in the NSR catalyst is equal to or larger than the breakthrough start amount of a criterion catalyst and the flow rate of exhaust gas flowing through the NSR catalyst is equal to or higher than a predetermined lower limit flow rate. The apparatus diagnoses the NSR catalyst as normal if the $NO_X$ storage rate thus calculated is equal to or higher than a predetermined threshold and as abnormal if the $NO_X$ storage rate is lower than the predetermined threshold.

4 Claims, 7 Drawing Sheets

(51) Int. Cl.
*F01N 3/08* (2006.01)
*F02D 41/02* (2006.01)

(52) U.S. Cl.
CPC ..... *F01N 13/008* (2013.01); *F02D 41/0275* (2013.01); *F01N 2550/03* (2013.01); *F01N 2560/026* (2013.01); *F01N 2560/07* (2013.01)

[Fig. 1]
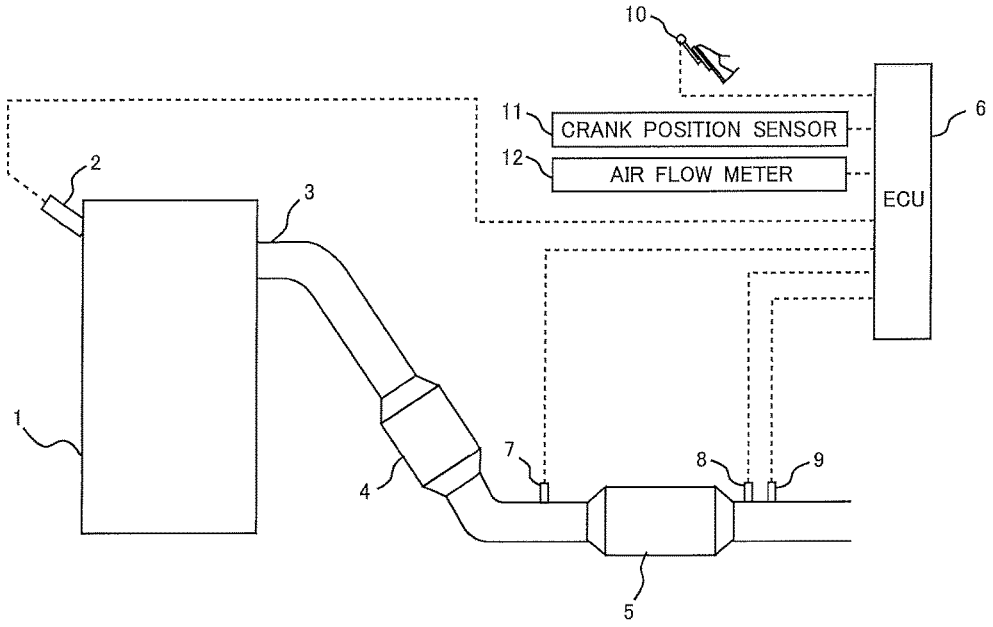

[Fig. 2]
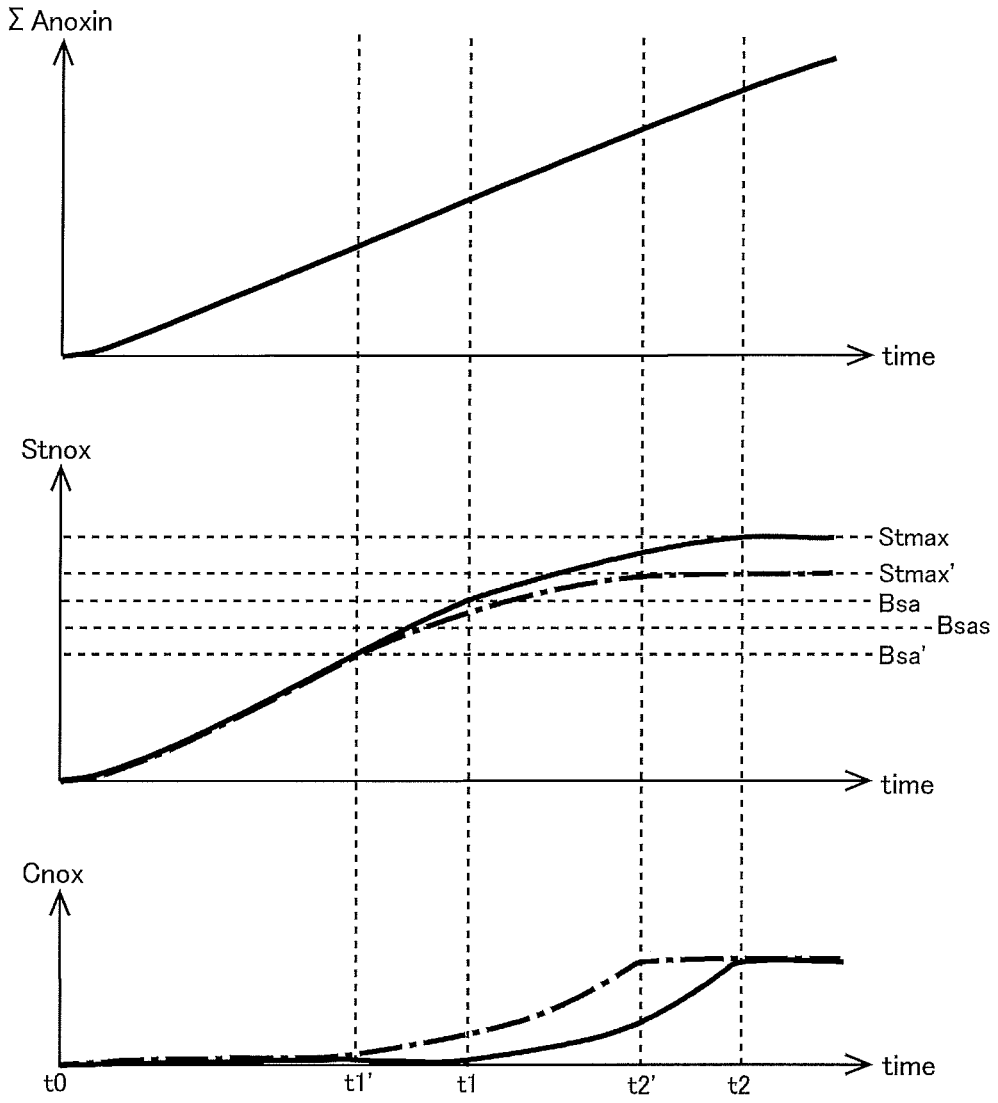

[Fig. 3]
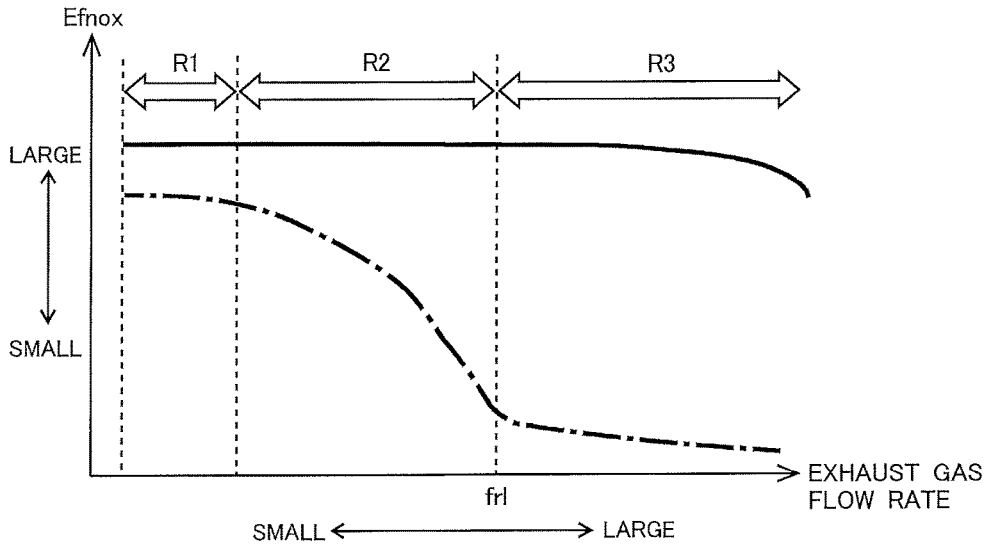

[Fig. 4]
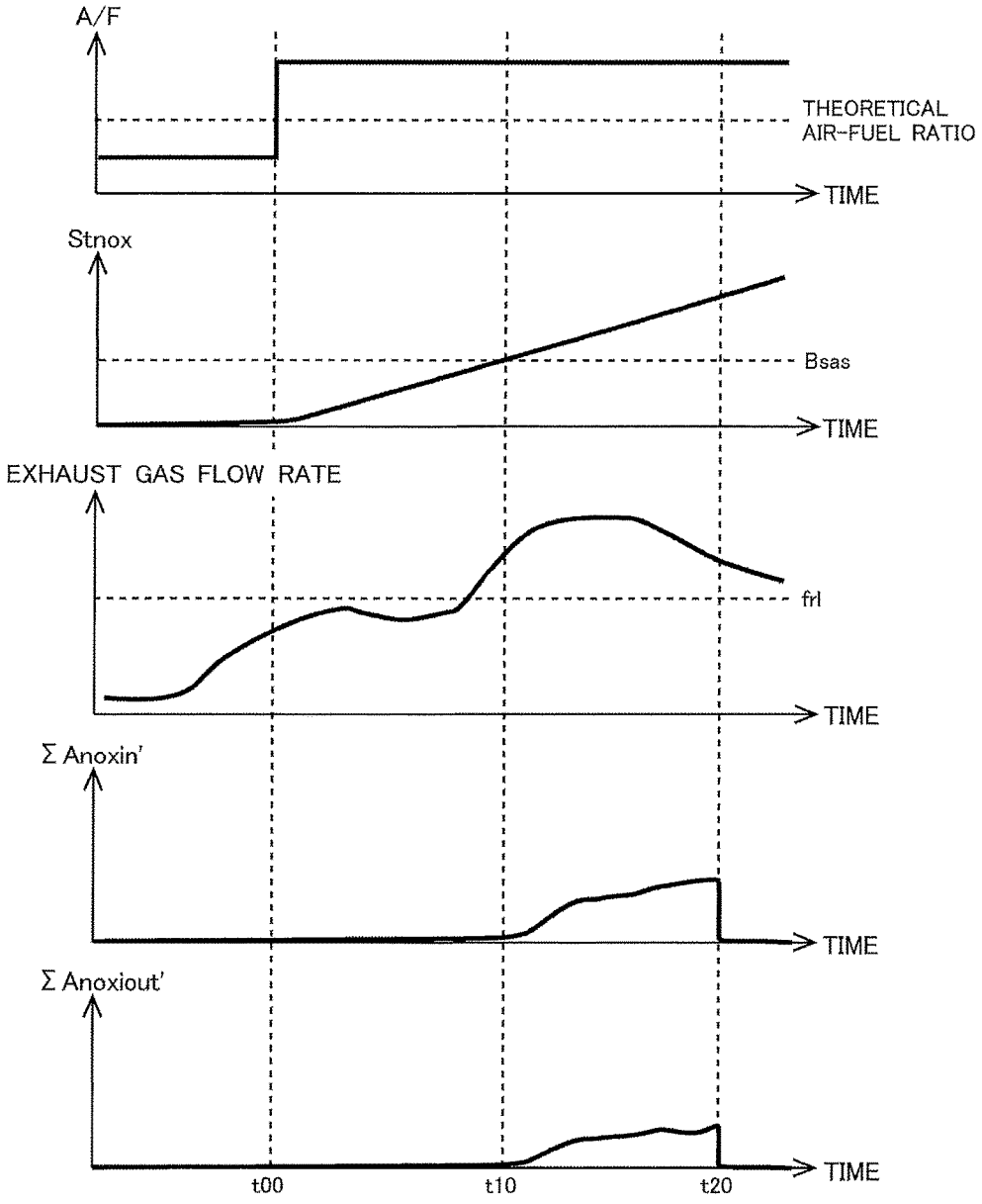

[Fig. 5]
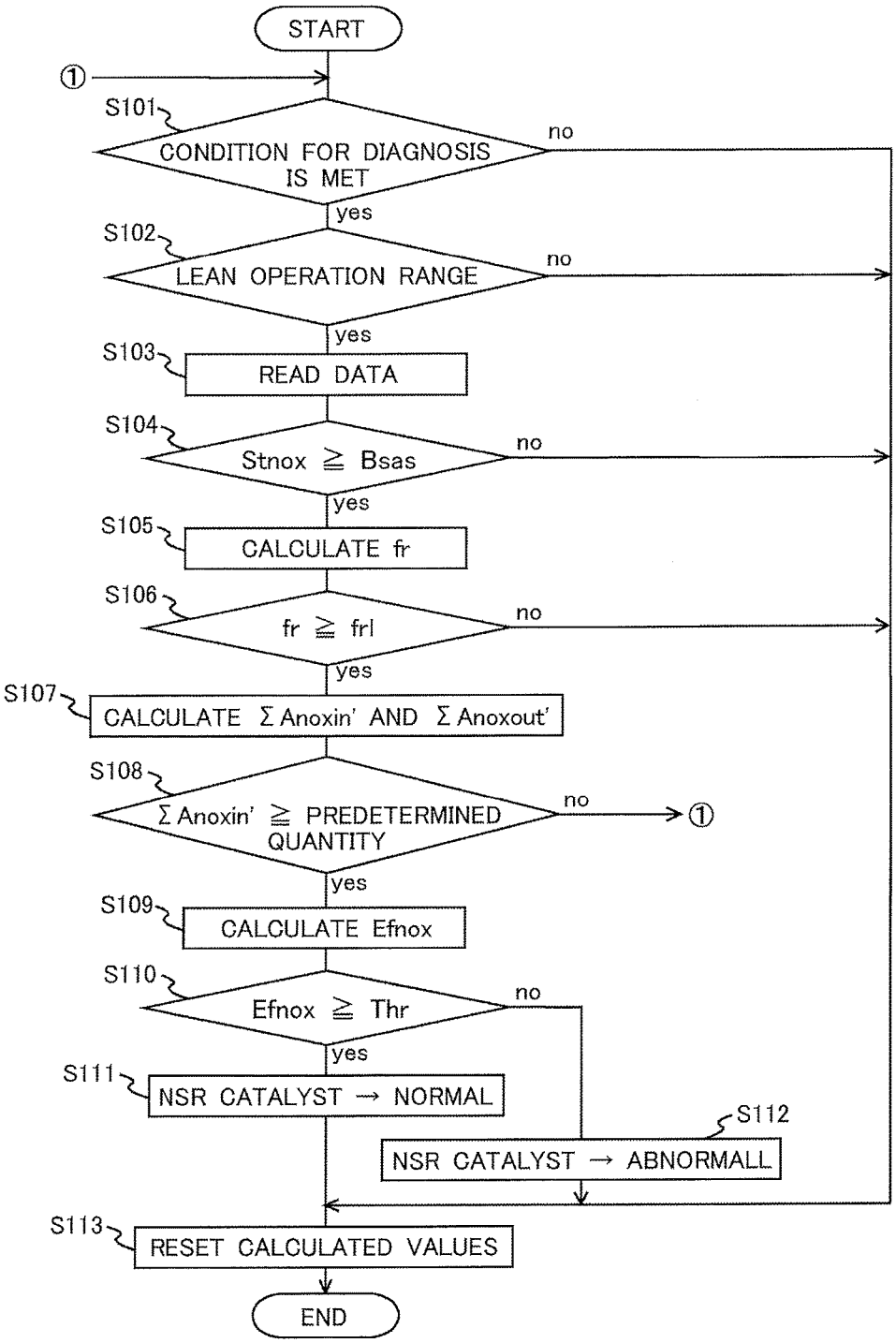

[Fig. 6]
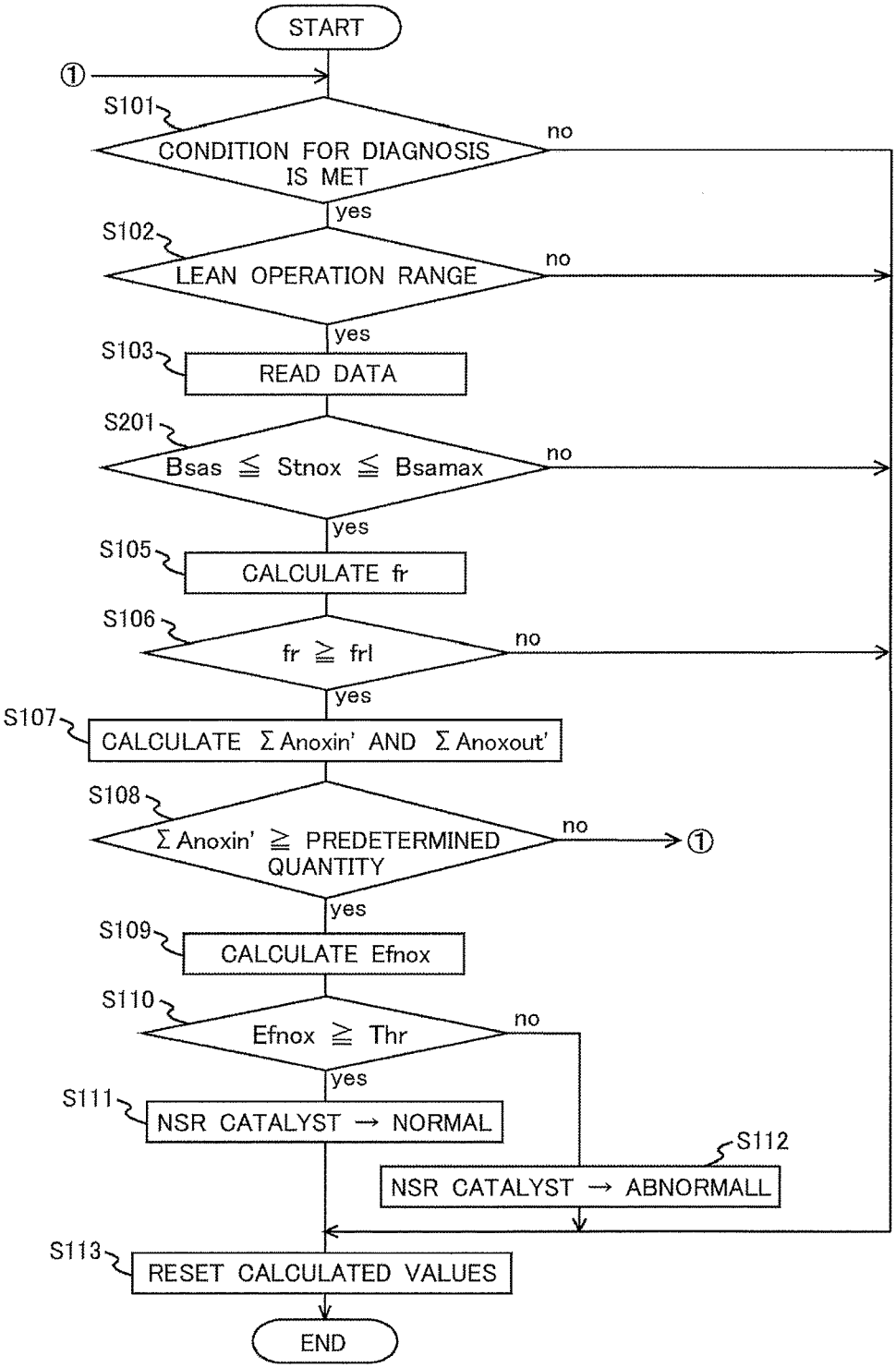

[Fig. 7]
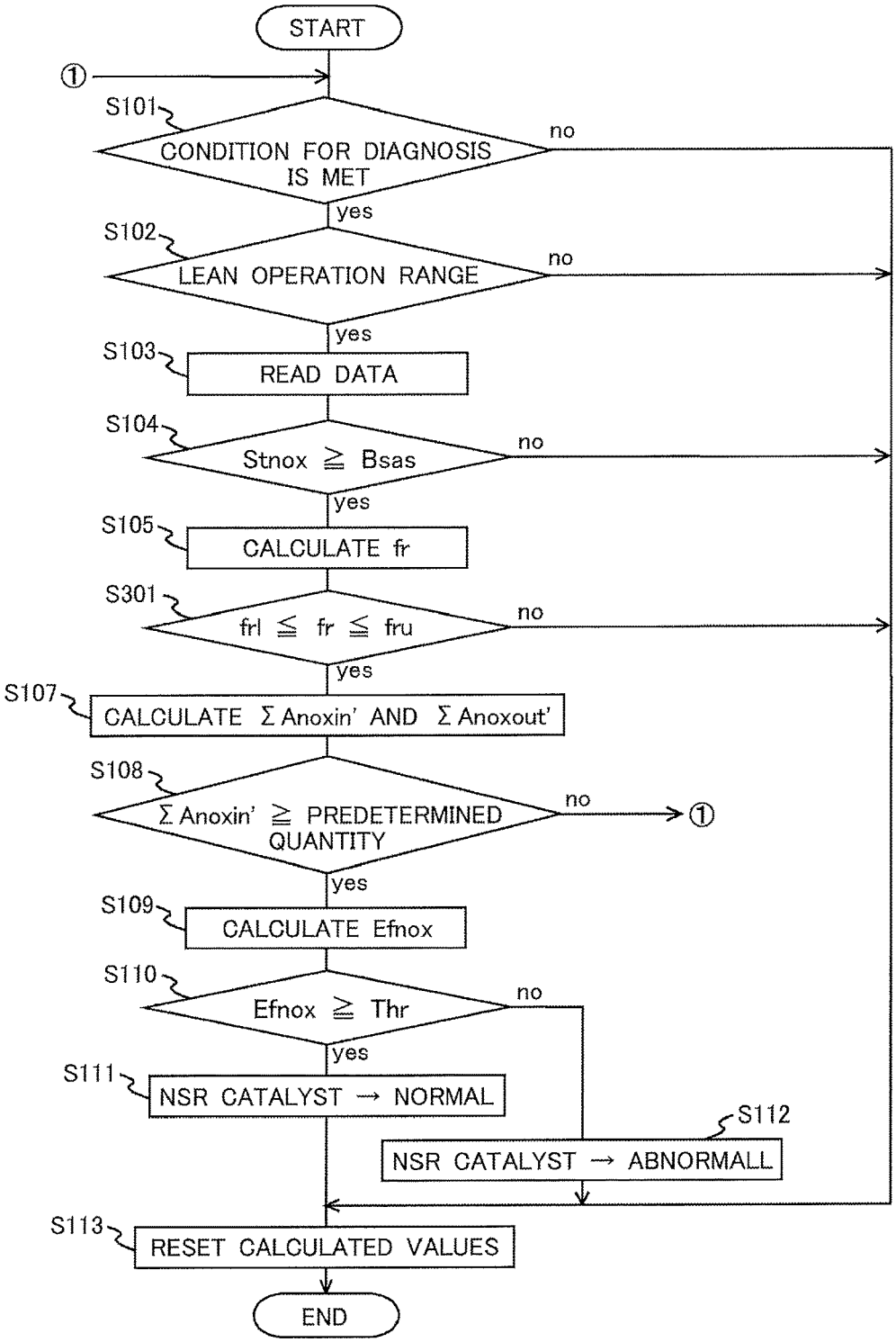

ABNORMALITY DIAGNOSIS APPARATUS FOR $NO_x$ STORAGE REDUCTION CATALYST

BACKGROUND OF THE INVENTION

Technical Field

The present invention relates to a technology pertaining to diagnosis of abnormality of an exhaust gas purification device and more particularly to a technology pertaining to diagnosis of abnormality of an $NO_X$ storage reduction (NSR) catalyst.

Description of the Related Art

An NSR catalyst is known as an exhaust gas purification device for a lean-burn internal combustion engine. The NSR catalyst stores $NO_X$ in the exhaust gas when the air-fuel ratio of the exhaust gas is a lean air-fuel ratio higher than the theoretical air-fuel ratio and desorbs and reduces $NO_X$ stored therein when the air-fuel ratio of the exhaust gas is a rich air-fuel ratio lower than the theoretical air fuel ratio. One known method of diagnosing an abnormality such as deterioration or failure of such an exhaust gas purification device is measuring the amount of $NO_X$ stored in the state in which the $NO_X$ storage capacity of the NSR catalyst is saturated (which will be hereinafter referred to as the saturation storage amount) and making a diagnosis that the exhaust gas purification device is in an abnormal condition if the saturation storage amount is smaller than a predetermined threshold (see, for example, patent literature 1).

CITATION LIST

Patent Literature

PTL 1: Japanese Patent Application Laid-Open No. 2009-138605

SUMMARY OF INVENTION

Nowadays, there is a trend that NSR catalysts are designed to have an increased $NO_X$ storage capacity to provide sufficient allowance taking account of the increased strictness of regulations in $NO_X$ emission control. Consequently, the time taken until saturation of the $NO_X$ storage capacity of NSR catalysts tends to be long. This may lead to a decrease in the frequency of measurement of the saturation storage capacity of the NSR catalyst with the aforementioned prior art method of abnormality diagnosis, making it difficult to detect an abnormality of the NSR catalyst promptly.

The present invention has been made in view of the above-described circumstances, and an object of the present invention is to provide a technology that enables an abnormality diagnosis apparatus that diagnoses an abnormality of an NSR catalyst to detect an abnormality of the NSR catalyst promptly with high accuracy.

To solve the above problem, an apparatus according to the present invention is adapted to determine the $NO_X$ storage rate of an $NO_X$ storage reduction catalyst in a state in which the amount of $NO_X$ stored in the $NO_X$ storage reduction catalyst is equal to or larger than the breakthrough start amount of a criterion catalyst that is in a condition on the border between normal and abnormal and the flow rate of exhaust gas flowing through the $NO_X$ storage reduction catalyst is equal to or higher than a predetermined lower limit flow rate and to diagnose an abnormality of the $NO_X$ storage reduction catalyst based on the $NO_X$ storage rate thus determined.

Specifically, an apparatus according to the present invention is an abnormality diagnosis apparatus for an $NO_X$ storage reduction catalyst applied to an internal combustion engine capable of operating in a lean-burn mode and provided with an $NO_X$ storage reduction catalyst arranged in an exhaust passage and having the capability of storing $NO_X$ contained in exhaust gas flowing into it and the capability of reducing $NO_X$ stored in it and an $NO_X$ sensor arranged in said exhaust passage downstream of said $NO_X$ storage reduction catalyst. The abnormality diagnosis apparatus for an $NO_X$ storage reduction catalyst comprises first obtaining unit configured to obtain the flow rate of exhaust gas flowing through said $NO_X$ storage reduction catalyst; second obtaining unit configured to obtain an inflowing $NO_X$ quantity defined as the quantity of $NO_X$ flowing into said $NO_X$ storage reduction catalyst; third obtaining unit configured to obtain an outflowing $NO_X$ quantity defined as the quantity of $NO_X$ flowing out of said $NO_X$ storage reduction catalyst, based on an output of said $NO_X$ sensor; calculation unit configured to calculate an $NO_X$ storage amount defined as the amount of $NO_X$ stored in said $NO_X$ storage reduction catalyst, based on the inflowing $NO_X$ quantity obtained by said second obtaining unit; and diagnosis unit configured to calculate an $NO_X$ storage rate defined as the rate of the quantity of $NO_X$ stored into said $NO_X$ storage reduction catalyst to said inflowing $NO_X$ quantity, based on the inflowing $NO_X$ quantity obtained by said second obtaining unit and the outflowing $NO_X$ quantity obtained by said third obtaining unit at a time when the exhaust gas flow rate obtained by said first obtaining unit is equal to or higher than a predetermined lower limit flow rate in a state in which the $NO_X$ storage amount calculated by said calculation unit is smaller than an amount with which the $NO_X$ storage capability of a criterion catalyst is saturated and equal to or larger than a breakthrough start amount defined as the amount at which a breakthrough in the $NO_X$ storage capability of said criterion catalyst starts, and to diagnose said $NO_X$ storage reduction catalyst as abnormal if the calculated $NO_X$ storage rate is lower than a predetermined threshold and as normal if the calculated $NO_X$ storage rate is equal to or higher than said predetermined threshold.

The criterion catalyst mentioned above is an $NO_X$ storage reduction catalyst (NSR catalyst) that is in a condition on the border between normal and abnormal. The breakthrough of the $NO_X$ storage capability mentioned above refers to a state in which the $NO_X$ storage capability of the NSR catalyst is not saturated yet and a portion of $NO_X$ flowing into the NSR catalyst slips through the NSR catalyst without being stored into it. Thus, it refers to a state in which the $NO_X$ storage rate is equal to or lower than a certain $NO_X$ storage rate that is higher than 0% and at which it can be considered that $NO_X$ flowing into the NSR catalyst is not stored entirely into the NSR catalyst. In other words, the breakthrough of the $NO_X$ storage capability refers to a state in which the rate of the quantity of $NO_X$ slipping through the NSR catalyst to the quantity of $NO_X$ flowing into it (which will be hereinafter referred to as "$NO_X$ slippage rate") is equal to or higher than a certain rate that is lower than 100% and at which it can be considered that $NO_X$ flowing into the NSR catalyst is not stored entirely into the NSR catalyst. Therefore, the breakthrough start amount mentioned above is an amount smaller than the saturation storage amount of the criterion catalyst and equal to the $NO_X$ storage amount at the time when a portion of $NO_X$ flowing into the NSR catalyst starts to slip through the NSR catalyst without being stored into it. Thus, the breakthrough start amount is equal to the $NO_X$ storage amount at the time when the aforementioned $NO_X$ storage rate decreases to the aforementioned certain $NO_X$ storage rate, in other words, at the time when the aforementioned $NO_X$ slippage rate reaches to the aforementioned certain rate. The predetermined threshold mentioned above is a value equal to the $NO_X$ storage rate of the aforementioned criterion catalyst or value equal to the $NO_X$ storage rate of the aforementioned criterion catalyst plus a certain margin.

The NSR catalyst stores $NO_X$ contained in the exhaust gas flowing into the NSR catalyst when the air-fuel ratio of the exhaust gas flowing into the NSR catalyst is a lean air-fuel ratio because of lean-burn operation of the internal combustion engine. When the $NO_X$ storage amount in the NSR catalyst is relatively small, the $NO_X$ storage capacity of the NSR catalyst has room, and $NO_X$ contained in the exhaust gas is stored into the NSR catalyst substantially entirely, namely the aforementioned $NO_X$ slippage rate is equal to or lower than the aforementioned certain rate. Consequently, the quantity of $NO_X$ slipping through the NSR catalyst is very small. As the $NO_X$ storage amount in the NSR catalyst increases beyond the breakthrough start amount of the NSR catalyst later, a portion of $NO_X$ flowing into the NSR catalyst slips through the NSR catalyst without being stored into the NSR catalyst, namely the aforementioned $NO_X$ slippage rate exceeds the aforementioned certain rate). In consequence, the quantity of $NO_X$ slipping through the NSR catalyst increases gradually. When the $NO_X$ storage amount reaches the saturation storage amount, almost the entirety of $NO_X$ flowing into the NSR catalyst starts to slip through the NSR catalyst without being stored into it.

The $NO_X$ storage amount at the time when a breakthrough of the $NO_X$ storage capability of the NSR catalyst starts (or the breakthrough start amount) is smaller in the case where the NSR catalyst is in an abnormal condition (namely, where the NSR catalyst is deteriorated or broken) than in the case where the NSR catalyst is in a normal condition. Given the above-described characteristics, it will be understood that diagnosis of abnormality of the NSR catalyst can be made based on the $NO_X$ storage rate determined in a state in which the $NO_X$ storage amount in the NSR catalyst is equal to or larger than the breakthrough start amount of the aforementioned criterion catalyst. In this method, the $NO_X$ storage rate may be determined using the inflowing $NO_X$ quantity and the outflowing $NO_X$ quantity in a state in which the $NO_X$ storage amount in the NSR catalyst is smaller than the saturation storage amount, and diagnosis of abnormality of the NSR catalyst can be made based on the $NO_X$ storage rate thus determined. Thus, an abnormality of the NSR catalyst can be detected promptly.

When the $NO_X$ storage amount is smaller than the breakthrough start amount of the NSR catalyst, the $NO_X$ storage rate is not apt to vary depending on the exhaust gas flow rate, because the $NO_X$ storage speed of the NSR catalyst is high. On the other hand, when the $NO_X$ storage amount is equal to or larger than the breakthrough start amount of the NSR catalyst, the $NO_X$ storage rate is apt to vary depending on the exhaust gas flow rate, because the $NO_X$ storage speed of the NSR catalyst is low. Therefore, if the NSR catalyst is in a normal condition, the $NO_X$ storage rate is not apt to vary depending on the exhaust gas flow rate when the $NO_X$ storage amount is equal to or larger than the breakthrough start amount of the criterion catalyst. On the other hand, if the NSR catalyst is in an abnormal condition, the $NO_X$ storage rate is apt to vary depending on the exhaust gas flow rate when the $NO_X$ storage amount is equal to or larger than the breakthrough start amount of the criterion catalyst. Specifically, in the case of the NSR catalyst in an abnormal condition, the $NO_X$ storage rate in a state in which the $NO_X$ storage amount is equal to or larger than the breakthrough start amount of the aforementioned criterion catalyst is higher when the exhaust gas flow rate is low than when it is high. Therefore, in the case where the NSR catalyst is in an abnormal condition, even in a state in which the $NO_X$ storage amount is equal to or larger than the breakthrough start amount of the aforementioned criterion catalyst, the $NO_X$ storage rate of the NSR catalyst would be relatively high so long as the exhaust gas flow rate is low. Then, the NSR catalyst in an abnormal condition and the NSR catalyst in a normal condition are unlikely to have a significant difference in the $NO_X$ storage rate.

When the internal combustion engine is in an operation state in which the exhaust gas flow rate is low, the absolute quantity of $NO_X$ contained in the exhaust gas is small. Then, if a measurement value (e.g. $NO_X$ concentration) of a sensor (e.g. $NO_X$ sensor used to obtain the outflowing $NO_X$ quantity) used in determining the $NO_X$ storage rate has an error, the percentage of error in the value of the outflowing $NO_X$ quantity calculated using that measurement value can be large, and the percentage of error in the calculated value of the $NO_X$ storage rate can also be large consequently.

If the percentage of error in the calculated value of the $NO_X$ storage rate is large in a situation in which the NSR catalyst in an abnormal condition and the NSR catalyst in a normal condition are unlikely to have a significant difference in the $NO_X$ storage rate, the NSR catalyst in an abnormal condition and the NSR catalyst in a normal condition might be more unlikely to have a significant difference in the $NO_X$ storage rate. For this reason, if the $NO_X$ storage rate is calculated based on the inflowing $NO_X$ quantity and the outflowing $NO_X$ quantity that are obtained at a time when the exhaust gas flow rate is relatively low in a state in which the $NO_X$ storage amount is equal to or larger than the breakthrough start amount of the aforementioned criterion catalyst, there is a possibility that an abnormality of the NSR catalyst cannot be detected with high accuracy.

In view of the above, the abnormality diagnosis apparatus for an $NO_X$ storage reduction catalyst according to the present invention is adapted to calculate the $NO_X$ storage rate based on the inflowing $NO_X$ quantity and the outflowing $NO_X$ quantity that are obtained at a time when the $NO_X$ storage amount in the NSR catalyst is equal to or larger than the breakthrough start amount of the aforementioned criterion catalyst and the exhaust gas flow rate is equal to or higher than the predetermined lower limit flow rate and to diagnose an abnormality of the NSR catalyst based on the $NO_X$ storage rate thus calculated. The predetermined lower limit flow rate mentioned above is a flow rate that is higher than the exhaust gas flow rate during idling of the internal combustion engine and at which it is considered that the NSR catalyst in a normal condition and the NSR catalyst in an abnormal condition would have a remarkable difference in the $NO_X$ storage rate (e.g. a difference larger than the error in the value of the $NO_X$ storage rate attributable to the aforementioned measurement error of the sensor). The lower limit flow rate as such is determined experimentally in advance.

With the above-described features, the abnormality diagnosis apparatus for an $NO_X$ storage reduction catalyst can detect an abnormality of the NSR catalyst promptly with high accuracy, even if there is a measurement error with the sensor as described above.

Since the operation state of the internal combustion engine is changed arbitrarily by the driver, it is not always the case that the internal combustion engine is in a driving state in which the exhaust gas flow rate is equal to or higher than the aforementioned lower limit flow rate at the time when the $NO_X$ storage amount reaches the breakthrough start amount of the aforementioned criterion catalyst. Therefore, it may take a time for the operation state that makes the exhaust gas flow rate equal to or higher than the aforementioned lower limit flow rate to start after the time when the $NO_X$ storage amount reaches the breakthrough start time of the aforementioned criterion catalyst. If this is the case, there is a possibility that the $NO_X$ storage amount may be equal to or larger than the breakthrough start amount of the NSR catalyst in a normal condition at the time when the operation of the internal combustion engine that makes the exhaust gas flow rate equal to or higher than the aforementioned lower limit flow rate starts. In the state in which the $NO_X$ storage amount is equal to or larger than the breakthrough start amount of the NSR catalyst in a normal condition, even when the NSR catalyst is normal, there is a possibility that the value of the $NO_X$ storage rate may be low. Then, there is a possibility that the NSR catalyst in an abnormal condition and the NSR catalyst in a normal condition may be unlikely to have a significant difference in the $NO_X$ storage rate. To address this problem, the diagnosis unit in the apparatus according to the present invention may be adapted to calculate the $NO_X$ storage rate based on the inflowing $NO_X$ quantity and the outflowing $NO_X$ quantity that are obtained at a time when the exhaust gas flow rate is equal to or higher than the aforementioned predetermined lower limit flow rate in a state in which the $NO_X$ storage amount is equal to or larger than the breakthrough start amount of the aforementioned criterion catalyst and smaller than a predetermined upper limit $NO_X$ storage amount larger than the breakthrough start amount of the aforementioned criterion catalyst and to make a diagnosis as to abnormality of the NSR catalyst based on the $NO_X$ storage rate thus calculated. In other words, the diagnoses unit may be adapted not to make a diagnosis as to abnormality of the NSR catalyst based on the $NO_X$ storage rate calculated from the inflowing $NO_X$ quantity and the outflowing $NO_X$ quantity that are obtained even in a state in which the $NO_X$ storage amount is equal to or larger than the breakthrough start amount of the aforementioned criterion catalyst and the exhaust gas flow rate is equal to or higher than the aforementioned predetermined lower limit flow rate, if the $NO_X$ storage amount is equal to or larger than the aforementioned predetermined upper limit $NO_X$ storage amount. The predetermined upper limit $NO_X$ storage amount mentioned above is set equal to the breakthrough start amount of the NSR catalyst that is in a condition equivalent to a brand new condition (for example, in a condition in which the NSR catalyst can exercise appropriate $NO_X$ removal capability taking account of exhaust gas control and a margin adapted to exhaust gas control). The above-described feature further improves the accuracy of diagnosis of abnormality of the NSR catalyst.

In some cases, the internal combustion engine may be in an operation state that makes the exhaust gas flow rate excessively higher than the aforementioned lower limit flow rate in a state in which the $NO_X$ storage amount reaches the breakthrough start amount of the aforementioned criterion catalyst. In the state in which the exhaust gas flow rate is excessively high, there is a possibility that the NSR catalyst cannot store $NO_X$ efficiently and the $NO_X$ storage rate may be low accordingly, even if the NSR catalyst is in a normal condition. Then, there is a possibility that the NSR catalyst in an abnormal condition and the NSR catalyst in a normal condition may be unlikely to have a significant difference in the $NO_X$ storage rate. To address this problem, the diagnosis unit in the apparatus according to the present invention may be adapted to calculate the $NO_X$ storage rate based on the inflowing $NO_X$ quantity and the outflowing $NO_X$ quantity that are obtained at a time when the exhaust gas flow rate is equal to or higher than the aforementioned predetermined lower limit flow rate and equal to or lower than a predetermined upper limit flow rate that is higher than the aforementioned predetermined lower limit flow rate in a state in which the $NO_X$ storage amount is equal to or larger than the breakthrough start amount of the aforementioned criterion catalyst and to make a diagnosis as to abnormality of the NSR catalyst based on the $NO_X$ storage rate thus calculated. In other words, the diagnoses unit may be adapted not to make a diagnosis as to abnormality of the NSR catalyst based on the $NO_X$ storage rate calculated from the inflowing $NO_X$ quantity and the outflowing $NO_X$ quantity that are obtained even in a state in which the $NO_X$ storage amount is equal to or larger than the breakthrough start amount of the aforementioned criterion catalyst and the exhaust gas flow rate is equal to or higher than the aforementioned predetermined lower limit flow rate, if the exhaust gas flow rate is higher than the aforementioned predetermined upper limit flow rate. The predetermined upper limit flow rate mentioned above is the flow rate of the exhaust gas flowing through the NSR catalyst above which it is considered that the NSR catalyst cannot store $NO_X$ efficiently even when the NSR catalyst is in a normal condition and the $NO_X$ storage amount is smaller than the breakthrough start amount of the NSR catalyst in a normal condition. The above-described feature further improves the accuracy of diagnosis of abnormality of the NSR catalyst.

The $NO_X$ storage rate can be expressed in terms of the aforementioned $NO_X$ slippage rate by the following equation (1):

$$NO_X \text{ storage rate } (\%) = 100(\%) - NO_X \text{ slippage rate } (\%) \quad (1).$$

Therefore, the diagnosis unit of the apparatus according to the present invention may make a diagnosis as to abnormality of the NSR catalyst using the $NO_X$ slippage rate instead of the $NO_X$ storage rate. In that case, the diagnosis unit may diagnose the NSR catalyst as abnormal if the $NO_X$ slippage rate of the NSR catalyst is higher than a predetermined $NO_X$ slippage rate (e.g. the $NO_X$ slippage rate of the aforementioned criterion catalyst or a value equal to the $NO_X$ slippage rate of the criterion catalyst minus a predetermined margin) and as normal if the $NO_X$ slippage rate of the NSR catalyst is equal or lower than the aforementioned predetermined slippage rate.

The present invention enables an abnormality diagnosis apparatus for an $NO_X$ storage reduction catalyst that makes a diagnosis as to abnormality of an NSR catalyst to detect an abnormality of the NSR catalyst promptly with high accuracy.

Further features of the present invention will become apparent from the following description of exemplary embodiments with reference to the attached drawings.

BRIEF DESCRIPTION OF THE DRAWINGS

FIG. 1 is a diagram showing the general configuration of an internal combustion engine and its exhaust system to which the present invention is applied.

FIG. 2 is a timing chart showing the change with time of the integrated inflowing $NO_X$ quantity ΣAnoxin, the change with time of the $NO_X$ storage amount Stnox, and the change with time of the $NO_X$ concentration Cnox in the exhaust gas flowing out of a first catalyst casing in a lean-burn operation period after the termination of $NO_X$ storage capability regeneration process.

FIG. 3 is a graph showing relationship between the $NO_X$ storage rate Efnox of an NSR catalyst and the exhaust gas flow rate in a state in which the $NO_X$ storage amount Stnox is equal to or larger than the standard breakthrough start amount Bsas.

FIG. 4 is a diagram illustrating a method of calculating the $NO_X$ storage rate Efnox.

FIG. 5 is a flow chart of a processing routine executed by an ECU when performing diagnosis of abnormality of the NSR catalyst.

FIG. 6 is a flow chart of a processing routine executed by an ECU when performing diagnosis of abnormality of the NSR catalyst in a first modification.

FIG. 7 is a flow chart of a processing routine executed by an ECU when performing diagnosis of abnormality of the NSR catalyst in a second modification.

DESCRIPTION OF THE EMBODIMENTS

In the following, specific embodiments of the present invention will be described with reference to the drawings. The dimensions, materials, shapes, relative arrangements, and other features of the components that will be described in connection with the embodiments are not intended to limit the technical scope of the present invention only to them, unless particularly stated.

FIG. 1 schematically shows the general configuration of an internal combustion engine to which the present invention is applied and its exhaust system. The internal combustion engine 1 shown in FIG. 1 is a spark-ignition internal combustion engine (gasoline engine) that can operate by burning air-fuel mixture having a lean air-fuel ratio higher than the theoretical air-fuel ratio (in a lean-burn mode). Alternatively, the internal combustion engine 1 may be a compression-ignition internal combustion engine.

The internal combustion engine 1 has a fuel injection valve 2 that supplies fuel into a cylinder. The fuel injection valve 2 may be adapted to inject fuel into an intake port of each cylinder or to inject fuel into the interior of each cylinder.

The internal combustion engine 1 is connected with an exhaust pipe 3 through which the gas having been burned in the cylinder (i.e. exhaust gas) flows. In the middle of the exhaust pipe 3, a first catalyst casing 4 is provided. The first catalyst casing 4 houses a three-way catalyst made up of a honeycomb structure coated with a coating layer such as alumina, a noble metal (such as platinum Pt or palladium Pd) supported on the coating layer, and a promotor such as ceria ($CeO_2$) supported on the coating layer.

In the exhaust pipe 3 downstream of the first catalyst casing 4, there is provided a second catalyst casing 5, which houses an $NO_X$ storage reduction catalyst (NSR catalyst). The second catalyst casing 5 houses a honeycomb structure coated with a coating layer such as alumina, a noble metal (such as platinum Pt or palladium Pd) supported on the coating layer, a promotor such as ceria ($CeO_2$) supported on the coating layer, and an $NO_X$ storage material (such as alkali or alkaline earth) supported on the coating layer.

The internal combustion engine 1 having the above-described structure is equipped with an ECU (Electronic Control Unit) 6 which acts as a controller according to the present invention. The ECU 6 is an electronic control unit composed of a CPU, a ROM, a RAM, and a backup RAM etc. The ECU 6 is electrically connected with various sensors including a first $NO_X$ sensor 7, a second $NO_X$ sensor 8, an exhaust gas temperature sensor 9, an accelerator position sensor 10, a crank position sensor 11, and an air flow meter 12.

The first $NO_X$ sensor 7 is attached to the exhaust pipe 3 between the first catalyst casing 4 and the second catalyst casing 5. The first $NO_X$ sensor 7 outputs an electrical signal representing the concentration of $NO_X$ contained in the exhaust gas flowing into the second catalyst casing 5. The second $NO_X$ sensor 8 is attached to the exhaust pipe 3 downstream of the second catalyst casing 5. The second $NO_X$ sensor 8 outputs an electrical signal representing the concentration of $NO_X$ contained in the exhaust gas flowing out of the second catalyst casing 5. The exhaust gas temperature sensor 9 is attached to the exhaust pipe 3 downstream of the second catalyst casing 5. The exhaust gas temperature sensor 9 outputs an electrical signal representing the temperature of the exhaust gas flowing out of the second catalyst casing 5.

The accelerator position sensor 10 is attached to the accelerator pedal. The accelerator position sensor 10 outputs an electrical signal representing the amount of operation of the accelerator pedal (or the accelerator opening degree). The crank position sensor 11 is attached to the internal combustion engine 1. The crank position sensor 11 outputs an electrical signal representing the rotational position of the engine output shaft (or the crankshaft). The air flow meter 12 is attached to an intake pipe (not shown) of the internal combustion engine 1. The air flow meter 12 outputs an electrical signal representing the quantity (or mass) of fresh air flowing in the intake pipe.

The ECU 6 controls the operation state of the internal combustion engine 1 on the basis of the output signals of the above-described sensors. For instance, the ECU 6 calculates a target air-fuel ratio of the air-fuel mixture based on the engine load, which is calculated based on the output signal of the accelerator position sensor 10 (accelerator opening degree), and the engine speed, which is calculated based on the output signal of the crank position sensor 11. Moreover, the ECU 6 calculates a target fuel injection quantity (or the duration of fuel injection) based on the target air-fuel ratio and the output signal of the air flow meter 12 (intake air quantity) and causes the fuel injection valve 2 to operate in accordance with the target fuel injection quantity. When the operation state of the internal combustion engine 1 is in a low-speed and low-load range or in a middle-speed and middle-load range, the ECU 6 sets the target air-fuel ratio to a lean air-fuel ratio higher than the theoretical air-fuel ratio. When the operation state of the internal combustion engine 1 is in a high-load range or in a high-speed range, the ECU 6 sets the target air-fuel ratio to the theoretical air-fuel ratio or a rich air-fuel ratio lower than the theoretical air-fuel ratio. As above, when the operation state of the internal combustion engine 1 is in a low-speed and low-load range or in a middle-speed and middle-load range (which will be collectively referred to as the "lean operation range"), the fuel consumption can be made small by operating the internal combustion engine 1 in a lean-burn mode with the target air-fuel ratio set to a lean air-fuel ratio.

When the operation state of the internal combustion engine 1 is in the aforementioned lean operation range, the ECU 6 performs an $NO_X$ storage capability regeneration process when appropriate. The $NO_X$ storage capability regeneration process is the process of adjusting the fuel injection quantity and the intake air quantity in such a way as to make the concentration of oxygen in the exhaust gas low and to make the concentration of hydrocarbon and carbon monoxide high. This process is sometimes called a rich spike process. The NSR catalyst housed in the second catalyst casing 5 stores $NO_X$ in the exhaust gas when the internal combustion engine 1 is operating in a lean-burn mode (namely, when the air-fuel ratio of the exhaust gas flowing into the second catalyst casing 5 is a lean air-fuel ratio). It should be noted that the term "store" (along with its derivatives) is used in this specification to express the mode in which the NSR catalyst stores $NO_X$ in the exhaust gas chemically and the mode in which the NSR catalyst adsorbs $NO_X$ physically. When the concentration of oxygen in the exhaust gas flowing into the second catalyst casing 5 is low and the exhaust gas contains reductive components such as hydrocarbon and carbon monoxide (in other words, when the air-fuel ratio of the exhaust gas is a rich air-fuel ratio), the NSR catalyst in the second catalyst casing 5 desorbs $NO_X$ stored therein and reduces the desorbed $NO_X$ into nitrogen ($N_2$) or ammonia ($NH_3$). Consequently, if the $NO_X$ storage capability regeneration process is performed, the $NO_X$ storage capability of the NSR catalyst is recovered.

The ECU 6 is adapted to perform the $NO_X$ storage capability regeneration process when the amount of $NO_X$ stored in the NSR catalyst ($NO_X$ storage amount) reaches or exceeds a certain amount, when the operation time (more preferably, the operation time in the state in which the target air-fuel ratio is set to a lean air-fuel ratio) since the completion of the last $NO_X$ storage capability regeneration process reaches or exceeds a certain time, or when the travel distance (more preferably, the travel distance in the state in which the target air-fuel ratio is set to a lean air-fuel ratio) after the completion of the last $NO_X$ storage capability regeneration process reaches or exceeds a certain distance, thereby preventing saturation of the $NO_X$ storage capacity of the NSR catalyst and reducing the amount of $NO_X$ emitted to the atmosphere.

A specific method of performing the $NO_X$ storage capability regeneration process may be to decrease the air-fuel ratio of the air-fuel mixture to be burned in the internal combustion engine 1 to a rich air-fuel ratio by increasing the target fuel injection quantity of the fuel injection valve 2 and/or decreasing the degree of opening of the intake throttle valve. In the case where the fuel injection valve 2 is adapted to inject fuel directly into the cylinder, the $NO_X$ storage capability regeneration process may be performed by injecting fuel through the fuel injection valve 2 during the exhaust stroke of the cylinder.

If an abnormal condition occurs in the NSR catalyst in the second catalyst casing 5 due to deterioration or failure, the quantity of $NO_X$ flowing into the second catalyst casing 5 but not stored in the NSR catalyst during lean-burn operation of the internal combustion engine increases, possibly leading to an increase in the quantity of $NO_X$ emitted to the atmosphere. Therefore, when the NSR catalyst in the second catalyst casing 5 is in an abnormal condition, it is necessary to detect the abnormality of the NSR catalyst promptly and to prompt the driver of the vehicle to fix it or to disable lean-burn operation of the internal combustion engine 1. In the following, a method of diagnosing abnormality of the NSR catalyst housed in the second catalyst casing 5 will be described.

FIG. 2 is a timing chart showing the change with time of the integrated value ΣAnoxin of the quantity of inflowing $NO_X$ since the start of the lean-burn operation (which will be hereinafter referred to as the "integrated inflowing $NO_X$ quantity"), the change with time of the $NO_X$ storage amount Stnox in the NSR catalyst (or the amount of $NO_X$ stored in the NSR catalyst), and the change with time of the $NO_X$ concentration Cnox in the exhaust gas flowing out of the second catalyst casing 5, during the lean-burn operation period after the completion of the $NO_X$ storage capability regeneration process. FIG. 2 shows a case in which the lean-burn operation is started immediately after the completion of the $NO_X$ storage capability regeneration process. In FIG. 2, the solid lines represent the changes with time of the respective values in a case where the NSR catalyst is in a normal condition, and the chain lines represent the changes with time of the respective values in a case where the NSR catalyst is in an abnormal condition.

As lean-burn operation is started upon completion of the $NO_X$ storage capability regeneration process for the NSR catalyst (at t0 in FIG. 2), the integrated inflowing $NO_X$ quantity ΣAnoxin starts to increase, and the $NO_X$ storage amount Stnox in the NSR catalyst also starts to increase accordingly. When the $NO_X$ storage amount Stnox in the NSR catalyst is relatively small, the substantially entire amount of $NO_X$ flowing into the second catalyst casing 5 is stored in the NSR catalyst. Therefore, the rate of the quantity of $NO_X$ stored into the NSR catalyst to the quantity of $NO_X$ flowing into the second catalyst casing 5 (or the $NO_X$ storage rate) is kept stably at a very high rate. In other words, the rate of the quantity of $NO_X$ slipping through the NSR catalyst to the quantity of $NO_X$ flowing into the second catalyst casing 5 (or the $NO_X$ slippage rate) is kept stably at a very low rate. In consequence, the $NO_X$ concentration Cnox in the exhaust gas flowing out of the second catalyst casing 5 is very low. When the $NO_X$ storage amount Stnox in the NSR catalyst becomes somewhat large with the increase of the integrated inflowing $NO_X$ quantity ΣAnoxin at a later time (at t1, t1' in FIG. 2), a breakthrough in the $NO_X$ storage capability of the NSR catalyst takes place, and a portion of $NO_X$ flowing into the second catalyst casing 5 starts to slip through the second catalyst casing 5 downstream without being stored in the NSR catalyst. In consequence, the aforementioned $NO_X$ slippage rate starts to increase gradually, and the $NO_X$ concentration Cnox in the exhaust gas flowing out of the second catalyst casing 5 also starts to increase accordingly. As the integrated inflowing $NO_X$ quantity ΣAnoxin increases further, the $NO_X$ storage amount Stnox in the NSR catalyst eventually reaches a saturation storage capacity Stmax, Stmax' (at t2, t2' in FIG. 2). From that time on, the $NO_X$ flowing into the second catalyst casing 5 slips through the NSR catalyst almost entirely. Then, the $NO_X$ concentration Cnox in the exhaust gas flowing out of the second catalyst casing 5 is substantially equal to the $NO_X$ concentration in the exhaust gas flowing into the second catalyst casing 5.

The saturation storage capacity Stmax' of the NSR catalyst in an abnormal condition is smaller than the saturation storage capacity Stmax of the NSR catalyst in a normal condition. Therefore, a diagnosis as to abnormality of the NSR catalyst can be made based on the saturation storage capacity of the NSR catalyst. However, nowadays there is a trend that NSR catalysts are designed to have an increased $NO_X$ storage capacity to provide sufficient allowance, and therefore the time taken until saturation of the $NO_X$ storage capacity of NSR catalysts tends to be long. This may lead to a decrease in the frequency of measurement of the saturation storage capacity of the NSR catalyst. In consequence, there may be cases where abnormality of the NSR catalyst cannot be detected promptly.

In this embodiment, what is focused on is the $NO_X$ storage amount Bsa, Bsa' at time t1, t1' in FIG. 2, that is, the $NO_X$ storage amount at the time when a portion of $NO_X$ flowing into the second catalyst casing 5 starts to slip through the NSR catalyst or the $NO_X$ storage amount at the time when the $NO_X$ slippage rate reaches a specific rate, which is lower than 100% and at which it can be considered that $NO_X$ flowing into the second catalyst casing 5 is not stored entirely in the NSR catalyst. The $NO_X$ storage amount Bsa, Bsa' at that time is the breakthrough start amount. The breakthrough start amount Bsa' with the NSR catalyst in an abnormal condition is smaller than the breakthrough start amount Bsa with the NSR catalyst in a normal condition. Consequently, during the period from t1' to t1 in FIG. 2, the $NO_X$ concentration Cnox in the exhaust gas flowing out of the second catalyst casing 5 is higher in the case where the NSR catalyst is in an abnormal condition than in the case where the NSR catalyst is in a normal condition. This is because during the period from t1' to t1 the $NO_X$ storage rate (i.e. the rate of the quantity of $NO_X$ stored into the NSR catalyst to the quantity of $NO_X$ flowing into the second catalyst casing 5) is lower in the case where the NSR catalyst is in an abnormal condition than in the case where the NSR catalyst is in a normal condition.

In this embodiment, the breakthrough start amount of a criterion catalyst (which is an NSR catalyst in a condition on the border between normal and abnormal) is determined experimentally in advance. This breakthrough start amount of the criterion catalyst is indicated as Bsas in FIG. 2. Moreover, the $NO_X$ storage rate of the NSR catalyst in the state in which its $NO_X$ storage amount Stnox reaches the breakthrough start amount Bsas of the criterion catalyst (which will be hereinafter referred to as the "standard breakthrough start amount") is calculated. A diagnosis as to abnormality of the NSR catalyst is made based on the $NO_X$ storage rate thus calculated. The $NO_X$ storage rate can be calculated by the following equation (2).

$$Efnox=(Anoxin-Anoxout)/Anoxin \quad (2).$$

In the above equation (2), Efnox is the $NO_X$ storage rate, Anoxin is the quantity of inflowing $NO_X$, and Anoxout is the quantity of outflowing $NO_X$. The inflowing $NO_X$ quantity Anoxin used in the calculation by the above equation (2) is calculated as the product of a measurement value of the first $NO_X$ sensor 7 and the exhaust gas flow rate (namely, the sum of the intake air quantity and the fuel injection quantity). When the internal combustion engine 1 is operating in the lean-burn mode, the inflowing $NO_X$ quantity correlates with the quantity of $NO_X$ discharged from the internal combustion engine 1 (or the quantity of $NO_X$ generated by combustion of the air-fuel mixture in the internal combustion engine 1). The quantity of $NO_X$ discharged from the internal combustion engine 1 correlates with the quantity of oxygen contained in the air-fuel mixture, the quantity of fuel contained in the air-fuel mixture, the fuel injection timing, and the engine speed. Therefore, the inflowing $NO_X$ quantity Anoxin may be estimated based on the correlation with these values. The outflowing $NO_X$ quantity Anoxout used in the calculation by the above equation (2) is calculated as the product of a measurement value of the second $NO_X$ sensor 8 and the exhaust gas flow rate.

In the case where the NSR catalyst is in a normal condition, the breakthrough start amount Bsa of the NSR catalyst is larger than the aforementioned standard breakthrough start amount Bsas. Therefore, at the time at which the $NO_X$ storage amount Stnox reaches the aforementioned standard breakthrough start amount Bsas, a breakthrough in the $NO_X$ storage capability of the NSR catalyst has not taken place yet, if the NSR catalyst is in a normal condition. Then, the $NO_X$ storage rate Efnox calculated by the above equation (2) will be higher than the $NO_X$ storage rate with the criterion catalyst. On the other hand, in the case where the NSR catalyst is in an abnormal condition, the breakthrough start amount Bsa' of the NSR catalyst is smaller than the aforementioned standard breakthrough start amount Bsas. Therefore, at the time at which the $NO_X$ storage amount Stnox reaches the aforementioned standard breakthrough start amount Bsas, a breakthrough in the $NO_X$ storage capability of the NSR catalyst has taken place already, if the NSR catalyst is in an abnormal condition. Then, the $NO_X$ storage rate Efnox calculated by the above equation (2) will be lower than the $NO_X$ storage rate with the criterion catalyst.

In view of the above-described tendencies, it is considered that a diagnosis as to abnormality of the NSR catalyst can be made by comparing the $NO_X$ storage rate Efnox calculated by the above equation (2) with the $NO_X$ storage rate with the criterion catalyst. However, the $NO_X$ storage rate Efnox with the NSR catalyst in an abnormal condition may vary depending on the exhaust gas flow rate. In the case where the NSR catalyst is in a normal condition, the $NO_X$ storage rate EFnox in the state in which the $NO_X$ storage amount Stnox is larger than or equal to the aforementioned standard breakthrough start amount Bsas is unlikely affected by the exhaust gas flow rate. On the other hand, in the case where the NSR catalyst is in an abnormal condition, the $NO_X$ storage rate EFnox in the state in which the $NO_X$ storage amount Stnox is larger than or equal to the aforementioned standard breakthrough start amount Bsas tends to be affected by the exhaust gas flow rate. FIG. 3 shows relationship between the $NO_X$ storage rate Efnox of the NSR catalyst and the exhaust gas flow rate. In FIG. 3, the solid line represents the $NO_X$ storage rate with the NSR catalyst in a normal condition, and the chain line represents the $NO_X$ storage rate with the NSR catalyst in an abnormal condition. The $NO_X$ storage rate of the NSR catalyst shown in FIG. 3 is that in a state in which the $NO_X$ storage amount Stnox is equal to or larger than the aforementioned standard breakthrough start amount Bsas.

In FIG. 3, in the case where the NSR catalyst is in a normal condition, the $NO_X$ storage rate is stable irrespective of the exhaust gas flow rate, because the $NO_X$ storage speed of the NSR catalyst is high. In the case where the NSR catalyst is in an abnormal condition, the $NO_X$ storage rate varies depending on the exhaust gas flow rate, because the $NO_X$ storage speed of the NSR catalyst is low. Specifically, in the range in which the exhaust gas flow rate is low (in range R1 in FIG. 3), as is the case during idling and low speed operation, the $NO_X$ storage rate with the NSR catalyst in an abnormal condition can be relatively high. On the other hand, in the range in which the exhaust gas flow rate is relatively high (in ranges R2 and R3 in FIG. 3), as is the case during middle speed operation and high speed operation, the $NO_X$ storage rate with the NSR catalyst in an abnormal condition is relatively low.

With the characteristics shown in FIG. 3, the difference between the $NO_X$ storage rate with the NSR catalyst in an abnormal condition and the $NO_X$ storage rate with the NSR catalyst in a normal condition is small when the exhaust gas flow rate is in the range R1 in FIG. 3. During idling and low speed operation, since the quantity of $NO_X$ discharged from the internal combustion engine 1 (namely, the absolute quantity of $NO_X$ contained in the exhaust gas) is small, there is a possibility that the percentage of error in the calculated value of the $NO_X$ storage rate can be high due to errors in measurement values of the sensors (such as the first $NO_X$ sensor 7 and the second $NO_X$ sensor) used to calculate the $NO_X$ storage rate. Therefore, if the $NO_X$ storage rate is calculated using measurement values of the first $NO_X$ sensor 7 and the second $NO_X$ sensor 8 at a time when the exhaust gas flow rate is in the range R1 in FIG. 3, an abnormality of the NSR catalyst cannot be detected accurately in some cases.

Therefore, in order to detect an abnormality of the NSR catalyst accurately, it is preferable that the $NO_X$ storage rate be calculated using measurement values of the first $NO_X$ sensor 7 and the second $NO_X$ sensor 8 obtained at a time when the exhaust gas flow rate is in the range R2 or R3 in FIG. 3 and that diagnosis of abnormality of the NSR catalyst be made based on the $NO_X$ storage rate thus calculated. In other word, it is preferable that the $NO_X$ storage rate used in diagnosing abnormality of the NSR catalyst be calculated using measurement values of the first $NO_X$ sensor 7 and the second $NO_X$ sensor 8 obtained at a time when the exhaust gas flow rate is equal to or higher than the limit flow rate of the range R2 in FIG. 3. When the exhaust gas flow rate is in the range R2 in FIG. 3, while the difference between the $NO_X$ storage rate with the NSR catalyst in a normal condition and the $NO_X$ storage rate with the NSR catalyst in an abnormal condition is large, the $NO_X$ storage rate with the NSR catalyst in an abnormal condition is liable to vary depending on the exhaust gas flow rate. Therefore, it is more preferable that the $NO_X$ storage rate be calculated using measurement values of the first $NO_X$ sensor 7 and the second $NO_X$ sensor 8 obtained at a time when the exhaust gas flow rate is in the range R3 in FIG. 3 and that diagnosis of abnormality of the NSR catalyst be made based on the $NO_X$ storage rate thus calculated.

In this embodiment, the $NO_X$ storage rate is calculated using measurement values of the first $NO_X$ sensor 7 and the second $NO_X$ sensor 8 obtained at a time when the $NO_X$ storage amount Stnox in the NSR catalyst is equal to or larger than the aforementioned standard breakthrough start amount Bsas and the exhaust gas flow rate is equal to or higher than the lower limit flow rate of the range R3 in FIG. 3 (which is indicated as fr1 in FIG. 3), and diagnosis of abnormality of the NSR catalyst is made based on the $NO_X$ storage rate thus calculated. Specifically, the inflowing $NO_X$ quantity Anoxin and the outflowing $NO_X$ quantity Anoxout are calculated using measurement values of the first $NO_X$ sensor 7 and the second $NO_X$ sensor 8 obtained at a time when the $NO_X$ storage amount Stnox is equal to or larger than the aforementioned standard breakthrough start amount Bsas and the exhaust gas flow rate is equal to or higher than the aforementioned lower limit flow rate fr1 during lean-burn operation of the internal combustion engine 1. Subsequently, the inflowing $NO_X$ quantity Anoxin and the outflowing $NO_X$ quantity Anoxout thus calculated are substituted into equation (2) presented above to calculate the $NO_X$ storage rate Efnox. If the $NO_X$ storage rate Efnox thus calculated is equal to or higher than a predetermined threshold, it may be diagnosed that the NSR catalyst is normal. If the $NO_X$ storage rate Efnox thus calculated is lower than a predetermined threshold, it may be diagnosed that the NSR catalyst is abnormal. The predetermined threshold mentioned above may be the $NO_X$ storage rate of the criterion catalyst. In order to improve the accuracy in detecting an abnormality of the NSR catalyst, it is preferable that the aforementioned predetermined threshold be set to a value equal to the $NO_X$ storage rate of the criterion catalyst plus a predetermined margin. The predetermined margin is set in such a way that the $NO_X$ storage rate Efnox of the NSR catalyst will not reach or exceed the aforementioned predetermined threshold if the $NO_X$ removal capability of the NSR catalyst is lower than the $NO_X$ removal capability of the criterion catalyst. The lower limit flow rate fr1 mentioned above corresponds to the predetermined lower limit flow rate according to the present invention.

The $NO_X$ storage rate Efnox used in diagnosis of abnormality of the NSR catalyst may be either a value calculated by the above equation (2) at a certain instance or the average of values at multiple instances. Referring to FIG. 4, the $NO_X$ storage rate Efnox used in diagnosis of abnormality of the NSR catalyst may be calculated from the integrated value ΣAnoxin' of the inflowing $NO_X$ quantity Anoxin and the integrated value ΣAnoxout' of the outflowing $NO_X$ quantity Anoxout over a predetermined period of time (between t10 and t20 in FIG. 4) from the time (t10 in FIG. 4) when the condition that the $NO_X$ storage amount Stnox reaches or exceeds the aforementioned standard breakthrough start amount Bsas and the exhaust gas flow rate is equal to or higher than the aforementioned lower limit flow rate fr1 is met during the period in which the internal combustion engine 1 is operating in a lean-burn mode (namely, during the period after t00 in FIG. 4). The predetermined period of time mentioned above is a period of time needed to assure accuracy in calculation of the $NO_X$ storage rate Efnox. It is, for example, a time taken for the integrated value of the inflowing $NO_X$ quantity from the time when the condition that the $NO_X$ storage amount Stnox reaches or exceeds the aforementioned standard breakthrough start amount Bsas and the exhaust gas flow rate fr is equal to or higher than the aforementioned lower limit flow rate fr1 is met to reach a predetermined quantity. The predetermined quantity mentioned above is a quantity needed to calculate the $NO_X$ storage rate Efnox with high accuracy in spite of assumed variations of measurement values of the first $NO_X$ sensor 7 and the second $NO_X$ sensor 8 caused by disturbances. This predetermined quantity is determined in advance by an adaptation process based on, for example, an experiment. In the case where the $NO_X$ storage rate Efnox is calculated by this method, the $NO_X$ storage rate Efnox may be calculated by the following equation (3):

$$Efnox=(\Sigma Anoxin'-\Sigma Anoxout')/\Sigma Anoxin' \quad (3).$$

In the case where diagnosis of abnormality of the NSR catalyst is made using the $NO_X$ storage rate Efnox calculated by the above equation (3), the $NO_X$ storage rate of the criterion catalyst is also calculated by the above equation (3) in advance, and the predetermined threshold is determined by adding a predetermined margin to the $NO_X$ storage rate of the criterion catalyst. The predetermined margin mentioned above is determined in such a way that the $NO_X$ storage rate Efnox calculated by the above equation (3) will not reach or exceed the aforementioned threshold if the $NO_X$ removal capability of the NSR catalyst is lower than the $NO_X$ removal capability of the criterion catalyst. In the case where diagnosis of abnormality of the NSR catalyst is made by this method, an abnormality of the NSR catalyst can be detected with improved reliability, even if measurement values of the first $NO_X$ sensor 7 and the second $NO_X$ sensor 8 vary due to disturbances.

In the following, the process of diagnosing abnormality of the NSR catalyst in this embodiment will be described with reference to FIG. 5. FIG. 5 is a flow chart of a processing routine executed by the ECU 6 when diagnosing abnormality of the NSR catalyst. This processing routine is stored in the ROM of the ECU 6 and executed repeatedly at predetermined timing.

In the processing routine in FIG. 5, firstly in step S101, the ECU 6 determines whether or not a condition for diagnosis is met. The condition for diagnosis mentioned above is, for example, the NSR catalyst is active and the first $NO_X$ sensor 7 and the second $NO_X$ sensor 8 are active. If the determination made in step S101 is affirmative, the processing of the ECU 6 proceeds to step S102.

In step S102, the ECU 6 determines whether or not the operation condition of the internal combustion engine 1 is in the aforementioned lean operation range (namely, whether or not the target air fuel ratio of the air-fuel mixture is a lean air-fuel ratio). If the determination made in step S102 is affirmative, the processing of the ECU 6 proceeds to step S103.

In step S103, the ECU 6 reads various data. Specifically, the ECU 6 reads the measurement value of the first $NO_X$ sensor 7 (i.e. the $NO_X$ concentration in the exhaust gas flowing into the second catalyst casing 5), the measurement value of the second $NO_X$ sensor 8 (i.e. the $NO_X$ concentration in the exhaust gas flowing out of the second catalyst casing 5), the measurement value of the air flow meter 12 (i.e. the intake air quantity), the fuel injection quantity, and the $NO_X$ storage amount Stnox. The $NO_X$ storage amount Stnox is calculated in another routine and stored in the backup RAM or other unit. The $NO_X$ storage amount Stnox is calculated by integrating the quantity of $NO_X$ stored into the NSR catalyst (namely, the difference between the inflowing $NO_X$ quantity Anoxin and the outflowing $NO_X$ quantity Anoxout) while the internal combustion engine 1 is operating in a lean-burn mode. However, if a rich spike process such as the above-described $NO_X$ storage capability regeneration process is performed for the purpose of recovering the $NO_X$ storage capability of the NSR catalyst, $NO_X$ stored in the NSR catalyst is reduced and the $NO_X$ storage amount Stnox decreases consequently. Therefore, when a rich spike process is performed, the quantity of $NO_X$ reduced in the NSR catalyst may be determined by utilizing the fact that the second $NO_X$ sensor 8 is, by its nature, sensitive not only to $NO_X$ in the exhaust gas but also to $NH_3$ produced by reduction of $NO_X$, and the quantity of reduced $NO_X$ thus determined may be subtracted from the $NO_X$ storage amount Stnox.

In step S104, the ECU 6 determines whether or not the $NO_X$ storage amount Stnox read in step S103 is equal to or larger than the aforementioned breakthrough start amount Bsas (i.e. the breakthrough start amount of the aforementioned criterion catalyst). If the determination made in step S104 is affirmative, the processing of the ECU 6 proceeds to step S105.

In step S105, the ECU 6 calculates the exhaust gas flow rate fr by adding the intake air quantity and the fuel injection quantity read in step S103 together.

In step S106, the ECU 6 determines whether or not the exhaust gas flow rate fr calculated in step S105 is equal to or higher than a lower limit flow rate fr1. The lower limit flow rate fr1 mentioned above is the lowest exhaust gas flow rate at which it is considered that the NSR catalyst in a normal condition and the NSR catalyst in an abnormal condition surely have a distinctive difference in the $NO_X$ storage rate as described above with reference to FIG. 3 (i.e. the lower limit flow rate of range R3 in FIG. 3). If the determination made in step S106 is affirmative, the measurement values of the first $NO_X$ sensor 7 and the second $NO_X$ sensor 8 read in step S103 can be considered to be values obtained in a state in which the $NO_X$ storage amount Stnox is equal to or larger than the aforementioned standard breakthrough start amount Bsas and the exhaust gas flow rate fr is equal to or higher than the aforementioned lower limit flow rate fr1. Therefore, if the determination made in step S106 is affirmative, the ECU 6 calculates, in steps S107 to S109, the $NO_X$ storage rate Efnox using the measurement values of the first $NO_X$ sensor 7 and the second $NO_X$ sensor 8 read in step S103.

In step S107, the ECU 6 calculates an integrated value ΣAnoxin' of the inflowing $NO_X$ quantity Anoxin and an integrated value ΣAnoxout' of the outflowing $NO_X$ quantity Anoxout over the period from the time when the condition that the $NO_X$ storage amount Stnox is equal to or larger than the aforementioned standard breakthrough start amount Bsas and the exhaust gas flow rate fr is equal to or higher than the aforementioned lower limit flow rate fr1 is met up until the present time. The integrated value ΣAnoxin' of the inflowing $NO_X$ quantity Anoxin and the integrated value ΣAnoxout' of the outflowing $NO_X$ quantity Anoxout calculated in this way will be hereinafter referred to as "inflowing $NO_X$ quantity for calculation" and "outflowing $NO_X$ quantity for calculation" respectively. Specifically, the ECU 6 firstly calculates the inflowing $NO_X$ quantity Anoxin as the product of the measurement value of the first $NO_X$ sensor 7 read in step S103 and the exhaust gas flow rate fr calculated in step S106. Furthermore, the ECU 6 calculates the outflowing $NO_X$ quantity Anoxout as the product of the measurement value of the second $NO_X$ sensor 8 read in step S103 and the exhaust gas flow rate fr calculated in step S106. Then, the ECU 6 calculates the inflowing $NO_X$ quantity for calculation ΣAnoxin' by adding the inflowing $NO_X$ quantity Anoxin to the inflowing $NO_X$ quantity for calculation calculated in the previous execution of the processing of step S107. Furthermore, the ECU 6 calculates the outflowing $NO_X$ quantity for calculation ΣAnoxout' by adding the outflowing $NO_X$ quantity Anoxout to the outflowing $NO_X$ quantity for calculation calculated in the previous execution of the processing of step S107.

In step S108, the ECU6 determines whether or not the inflowing $NO_X$ quantity for calculation ΣAnoxin' calculated in step S107 is equal to or larger than a predetermined quantity. The predetermined quantity mentioned above is a quantity needed to calculate the $NO_X$ storage rate Efnox with high accuracy in spite of assumed variations of measurement values of the first $NO_X$ sensor 7 and the second $NO_X$ sensor 8 caused by disturbances, as described above. This predetermined quantity is determined in advance by an adaptation process based on, for example, an experiment. If the determination made in step S108 is negative, the processing of the ECU 6 returns to step S101. On the other hand, if the determination made in step S108 is affirmative, the processing of the ECU 6 proceeds to step S109.

In step S109, the ECU 6 calculates the $NO_X$ storage rate Efnox by substituting the inflowing $NO_X$ quantity for calculation ΣAnoxin' and the outflowing $NO_X$ quantity for calculation ΣAnoxout' calculated in step S108 into equation (3) presented above.

In step S110, the ECU 6 determines whether or not the $NO_X$ storage rate Efnox calculated in step S109 is equal to or higher than a predetermined threshold Thr. The predetermined threshold Thr mentioned above is a value obtained by adding a predetermined margin to the $NO_X$ storage rate of the criterion catalyst, as described above. This predetermined margin is set in such a way that the $NO_X$ storage rate Efnox of the NSR catalyst will not reach or exceed the aforementioned threshold if the $NO_X$ removal capability of the NSR catalyst is lower than the $NO_X$ removal capability of the criterion catalyst. Setting the predetermined threshold Thr in the above-described manner helps preventing the NSR catalyst from being diagnosed mistakenly as normal when its $NO_X$ removal capability is lower than that of the criterion catalyst. Thus, an abnormality of the NSR catalyst can be detected with improved reliability.

If the determination made in step S110 is affirmative, the ECU 6 diagnoses the NSR catalyst as normal in step S111. On the other hand, if the determination made in step S110 is negative, the ECU 6 diagnoses the NSR catalyst as abnormal in step S112. In step S112, the ECU 6 may prompt the driver of the vehicle to replace or fix the second catalyst casing 5 by, for example, turning on a warning lamp provided in the cabin of the vehicle.

After executing the processing of steps S111 or S112, the ECU 6 executes the processing of step S113. In step S113, the ECU 6 resets various calculated values. Specifically, the ECU 6 resets the values of the inflowing $NO_X$ quantity for calculation ΣAnoxin' and the outflowing $NO_X$ quantity for calculation ΣAnoxout' to zero. In the case where a negative determination is made in step S101, S102, S104, or S106 also, the ECU 6 executes the processing of step S113 to reset the aforementioned calculated values.

Diagnosis of abnormality of the NSR catalyst carried out as above enables accurate and prompt detection of an abnormality of the NSR catalyst even in the case where measurement values of the first $NO_X$ sensor 7 and the second $NO_X$ sensor 8 have errors.

First Modification

In some cases, the internal combustion engine 1 may not be in an operation state that makes the exhaust gas flow rate fr equal to or higher than the aforementioned lower limit flow rate fr1 at the time when the $NO_X$ storage amount Stnox reaches the standard breakthrough start amount Bsas. If it takes a long time from the time when the $NO_X$ storage amount Stnox reaches the standard breakthrough start amount Bsas until the start of operation of the internal combustion engine 1 that makes the exhaust gas flow rate fr equal to or higher than the aforementioned lower limit flow rate fr1, the $NO_X$ storage amount Stnox at the time start of operation of the internal combustion engine 1 that makes the exhaust gas flow rate fr equal to or higher than the aforementioned lower limit flow rate fr1 would be excessively large, and there is a possibility that the $NO_X$ storage amount Stnox may exceed the breakage start amount of the NSR catalyst in a normal condition. Then, the value of the $NO_X$ storage rate Efnox can be low even when the NSR catalyst is in a normal condition.

In view of the above fact, the $NO_X$ storage rate Efnox may be calculated at a time when the exhaust gas flow rate fr is equal to or higher than the lower limit flow rate fr1 in a state in which the $NO_X$ storage amount Stnox is equal to or larger than the standard breakthrough start amount Bsas and smaller than an upper limit $NO_X$ storage amount that is larger than the standard breakthrough start amount Bsas. The upper limit $NO_X$ storage amount mentioned above is set equal to the breakthrough start amount of the NSR catalyst that is in a condition equivalent to a brand new condition (for example, in a condition in which the NSR catalyst can exercise appropriate $NO_X$ removal capability taking account of exhaust gas control and a margin adapted to exhaust gas control).

Specifically, the ECU 6 may diagnose abnormality of the NSR catalyst by the processing routine shown in FIG. 6. The processing routine shown in FIG. 6 differs from the processing routine shown in FIG. 5 in that the processing of step S201 is executed in place of the processing of step S104. In step S201, the ECU 6 determines whether or not the $NO_X$ storage amount Stnox read in step S103 is equal to or larger than the standard breakthrough start amount Bsas and smaller than the upper limit $NO_X$ storage amount Bsamax. If the determination made in step S201 is affirmative, the ECU 6 executes the processing of step S105 and the subsequent steps as in the case where an affirmative determination is made in step S104 in the processing routine shown in FIG. 5. On the other hand, if the determination made in step S201 is negative, the ECU 6 executes the processing of step S113 as in the case where a negative determination is made in step S104 in the processing routine shown in FIG. 5.

Diagnosis of abnormality of the NSR catalyst carried out as above improves the accuracy in diagnosis of abnormality of the NSR catalyst. In the processing routine shown in FIG. 6, the processing of step S108 may be replaced by the processing of determining whether or not the $NO_X$ storage amount Stnox reaches the aforementioned upper limit $NO_X$ storage amount Bsamax. In that case, the $NO_X$ storage rate Efnox is calculated based on the inflowing $NO_X$ quantity for calculation ΣAnoxin' and the outflowing $NO_X$ quantity for calculation ΣAnoxout' over the period from the time when the condition that the $NO_X$ storage amount Stnox reaches or exceeds the aforementioned standard breakthrough start amount Bsas and the exhaust gas flow rate fr is equal to or higher than the aforementioned lower limit flow rate fr1 is met until the $NO_X$ storage amount Stnox reaches the upper limit $NO_X$ storage amount Bsamax. Then, while the time taken by diagnosis of abnormality is somewhat longer, the $NO_X$ storage rate Efnox of the NSR catalyst can be calculated with higher accuracy. Consequently, diagnosis of abnormality of the NSR catalyst can be made with improved accuracy.

Second Modification

In some cases, the internal combustion engine 1 may be in an operation state that makes the exhaust gas flow rate fr excessively higher than the lower limit flow rate fr1 at the time when the $NO_X$ storage amount Stnox reaches the standard breakthrough start amount Bsas. In the state in which the exhaust gas flow rate is excessively high, there is a possibility that the NSR catalyst cannot store $NO_X$ efficiently and the $NO_X$ storage rate Efnox can be low accordingly, even if the NSR catalyst is in a normal condition.

To address the above problem, the $NO_X$ storage rate Efnox may be calculated at a time when the exhaust gas flow rate fr is equal to or higher than the lower limit flow rate fr1 and equal to or lower than an upper limit flow rate fru in a state in which the $NO_X$ storage amount Stnox is equal to or larger than the standard breakthrough start amount Bsas. The upper limit flow rate fru mentioned above is a value of the exhaust gas flow rate fr above which it is considered that the $NO_X$ slippage rate of the NSR catalyst becomes higher than a specific rate even when the NSR catalyst is in a normal condition. This upper limit flow rate fru is determined in advance by an experiment.

Specifically, the ECU 6 may diagnose abnormality of the NSR catalyst by the processing routine shown in FIG. 7. The processing routine shown in FIG. 7 differs from the processing routine shown in FIG. 5 in that the processing of step S301 is executed in place of the processing of step S106. In step S301, the ECU 6 determines whether or not the exhaust gas flow rate fr calculated in step S105 is equal to or higher than the lower limit flow rate fr1 and equal to or lower than the upper limit flow rate fru. If the determination made in step S301 is affirmative, the ECU 6 executes the processing of step S107 and subsequent steps as in the case where an affirmative determination is made in step S106 in the processing routine shown in FIG. 5. On the other hand, if the determination made in step S301 is negative, the ECU 6 executes the processing of step S113 as in the case where a negative determination is made in step S106 in the processing routine shown in FIG. 5.

Diagnosis of abnormality of the NSR catalyst carried out as above improves the accuracy in diagnosis of abnormality of the NSR catalyst. The second modification may be employed in combination with the above-described first modification. In that case, the processing of step S104 in the processing routine shown in FIG. 7 is replaced by the processing of step S201 in the processing routine shown in FIG. 6. Diagnosis of abnormality of the NSR catalyst carried out in this way further improves the accuracy in diagnosis of abnormality of the NSR catalyst.

In the above-described illustrative embodiment, the present invention is applied to the internal combustion engine 1 provided with the first catalyst casing 4 in which the three-way catalyst is housed and the second catalyst casing 5 in which the NSR catalyst is housed, which are arranged in the exhaust pipe 3. The present invention can also be applied to an internal combustion engine provided with a catalyst casing that is arranged in the exhaust pipe downstream of the second catalyst casing and in which a selective catalytic reduction catalyst (SCR catalyst) is housed.

Other Embodiments

The $NO_X$ storage rate Efnox can be expressed in terms of the $NO_X$ slippage rate as follows:

$$\text{Efnox}\ (\%)=100(\%)-NO_X\ \text{slippage rate}\ (\%).$$

Therefore, diagnosis of abnormality of the NSR catalyst can be made using the $NO_X$ slippage rate instead of the $NO_X$ storage rate Efnox. In that case, the ECU 6 may diagnose the NSR catalyst as abnormal if the $NO_X$ slippage rate of the NSR catalyst is higher than a predetermined $NO_X$ slippage rate (e.g. the $NO_X$ slippage rate of the aforementioned criterion catalyst or a value equal to the $NO_X$ slippage rate of the criterion catalyst minus a predetermined margin) and as normal if the $NO_X$ slippage rate of the NSR catalyst is equal or lower than the aforementioned predetermined slippage rate.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-147750, filed on Jul. 27, 2015, which is hereby incorporated by reference herein in its entirety.

What is claimed is:

1. An abnormality diagnosis apparatus for an $NO_X$ storage reduction catalyst applied to an internal combustion engine capable of operating in a lean-burn mode and provided with an $NO_X$ storage reduction catalyst arranged in an exhaust passage and having the capability of storing $NO_X$ contained in exhaust gas flowing into it and the capability of reducing $NO_X$ stored in it and a first NOX sensor arranged in said exhaust passage upstream of said NOX storage reduction catalyst and a second $NO_X$ sensor arranged in said exhaust passage downstream of said $NO_X$ storage reduction catalyst, the abnormality diagnosis apparatus comprising:

a controller comprising at least one processor configured to:

obtain the flow rate of exhaust gas flowing through said $NO_X$ storage reduction catalyst;

obtain an inflowing $NO_X$ quantity defined as the quantity of $NO_X$ flowing into said $NO_X$ storage reduction catalyst, based on an output of said first NOX sensor;

obtain an outflowing $NO_X$ quantity defined as the quantity of $NO_X$ flowing out of said $NO_X$ storage reduction catalyst, based on an output of said second $NO_X$ sensor;

calculate an $NO_X$ storage rate defined as the rate of the quantity of $NO_X$ stored into said $NO_X$ storage reduction catalyst to said inflowing $NO_X$ quantity, by dividing the difference between said inflowing NOX quantity and said outflowing NOX quantity by said inflowing NOX quantity during the period in which said internal combustion engine is operating in said lean-burn mode; and diagnose said $NO_X$ storage reduction catalyst as abnormal if the calculated $NO_X$ storage rate is lower than a predetermined threshold and as normal if the calculated $NO_X$ storage rate is equal to or higher than said predetermined threshold, wherein:

the quantity of NOX stored into said NOX storage reduction catalyst at a time when a breakthrough of the NOX storage capability of said NOX storage reduction catalyst starts is smaller where said NOX storage reduction catalyst is in an abnormal condition than where said NOX storage reduction catalyst is in a normal condition;

said predetermined threshold is a value equal to said NOX storage rate of a criterion catalyst which is said NOX storage reduction catalyst that is in a condition between normal and abnormal, or a value equal to said NOX storage rate of said criterion catalyst plus a certain margin; and said controller calculates said NOX storage rate if the obtained exhaust gas flow rate is equal to or higher than a predetermined lower limit flow rate in a state in which the quantity of NOX stored into said NOX storage reduction catalyst is smaller than an amount with which the NOX storage capability of said criterion catalyst is saturated and equal to or larger than a breakthrough start amount defined as the amount at which a breakthrough in the NOX storage capability of said criterion catalyst starts.

2. The abnormality diagnosis apparatus for an $NO_X$ storage reduction catalyst according to claim 1, wherein said controller calculates said $NO_X$ storage rate, if the obtained exhaust gas flow rate is equal to or higher than said predetermined lower limit flow rate in a state in which the quantity of NOX stored into said NOX storage reduction catalyst is equal to or larger than the breakthrough start amount of said criterion catalyst and smaller than an upper limit $NO_X$ storage amount which is set equal to the breakthrough start amount of said $NO_X$ storage reduction catalyst that is in a condition equivalent to a brand new condition.

3. The abnormality diagnosis apparatus for an $NO_X$ storage reduction catalyst according to claim 1, wherein said controller calculates said $NO_X$ storage rate, if the obtained exhaust gas flow rate is equal to or higher than said predetermined lower limit flow rate and equal to or lower than a predetermined upper limit flow rate that is higher than said predetermined lower limit flow rate in a state in which the quantity of NOX stored into said NOX storage reduction catalyst is equal to or larger than the breakthrough start amount of said criterion catalyst.

4. The abnormality diagnosis apparatus for an $NO_X$ storage reduction catalyst according to claim 2, wherein said controller calculates said $NO_X$ storage rate, if the obtained exhaust gas flow rate is equal to or higher than said predetermined lower limit flow rate and equal to or lower than a predetermined upper limit flow rate that is higher than said predetermined lower limit flow rate in a state in which the quantity of NOX stored into said NOX storage reduction catalyst is equal to or larger than the breakthrough start amount of said criterion catalyst.

* * * * *